US006769786B2

(12) United States Patent
Galli

(10) Patent No.: US 6,769,786 B2
(45) Date of Patent: Aug. 3, 2004

(54) WATERPROOF HEAD ASSEMBLY FOR A FLASHLIGHT

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 38 days.

(21) Appl. No.: 10/307,781

(22) Filed: Dec. 2, 2002

(65) Prior Publication Data

US 2003/0156406 A1 Aug. 21, 2003

Related U.S. Application Data

(63) Continuation of application No. 10/080,164, filed on Feb. 2, 2002, now Pat. No. 6,626,556.
(60) Provisional application No. 60/270,657, filed on Feb. 22, 2001.

(51) Int. Cl.[7] ..... F21V 31/00
(52) U.S. Cl. ..... 362/158; 362/188; 362/197; 362/203; 362/205; 200/60
(58) Field of Search ..... 362/158, 202, 362/187, 203, 197, 204, 205, 206, 188; 200/572, 60, 332.2, 17 R, 52 R

(56) References Cited

U.S. PATENT DOCUMENTS 4,376,966 A * 3/1983 Tieszen ..... 362/249
4,524,409 A 6/1985 Yakubek
4,733,337 A 3/1988 Bieberstein
4,985,812 A 1/1991 Uke
5,842,777 A 12/1998 McDermott
5,876,110 A 3/1999 Uke
5,904,414 A 5/1999 Monteleone et al.
6,053,623 A 4/2000 Jones et al.
6,135,605 A * 10/2000 Hsu et al. ..... 362/102
6,196,702 B1 3/2001 Krietzman
6,231,207 B1 5/2001 Kennedy et al.
6,283,611 B1 9/2001 Sharrah et al.
6,318,879 B1 11/2001 Huang
6,336,732 B1 1/2002 Shiau
6,390,640 B1 5/2002 Wong et al.
6,467,930 B1 10/2002 Frick
6,626,556 B2 * 9/2003 Galli ..... 362/205
2002/0018343 A1 2/2002 Steger
2002/0075683 A1 6/2002 Striebel et al.
2002/0097576 A1 7/2002 Sharrah et al.

* cited by examiner

*Primary Examiner*—John Anthony Ward
(74) *Attorney, Agent, or Firm*—Barlow, Josephs & Holmes, Ltd.

(57) ABSTRACT

The present invention provides a novel waterproof head assembly specifically designed for LED sources. The rounded end surfaces of the LED are exposed to the outside environment through apertures formed in a solid end wall of the head assembly. To prevent water from entering into the interior of the flashlight through the apertures, the present invention discloses filling the interior cavity of the head with a sealant which substantially entirely fills all of the gaps between the outside surfaces of the LED's, the inside surfaces of the apertures, and the inside surfaces of the open end of the head assembly.

9 Claims, 4 Drawing Sheets

WATERPROOF HEAD ASSEMBLY FOR A FLASHLIGHT

PRIORITY CLAIM TO EARLIER FILED APPLICATION

This application is a continuation of and claims priority from U.S. patent application No. 10/080,164, filed Feb. 2, 2002, now U.S. Pat. No. 6,626,556, and Provisional Patent Application No. 60/270,657, filed Feb. 22, 2001.

BACKGROUND OF THE INVENTION

The instant invention relates to a sealed, waterproof head assembly for a ruggedized LED flashlight More specifically, this invention relates to an internal sealing assembly that provides an integral and complete seal between the outer casing, lighting elements, and circuitry of the flashlight head. The flowable characteristics of the sealant and the manner in which the parts interfit create a unique structure not seen in the prior art.

Heretofore, the majority of flashlights utilized incandescent bulbs as a light source. The incandescent bulb was typically positioned within a cup reflector, which in turn was concentrically received within a threaded head ring. The outer end of the threaded ring included a clear acrylic cover to protect the incandescent bulb from damage while also allowing light from the bulb to project outwardly. The inner end of the head ring was inwardly threaded for receipt onto a complementary outward thread on the barrel of the flashlight housing. When waterproofing of the head was required, the manufacturers typically utilized compressible o-ring gaskets between the acrylic cover and the head ring, and also concentrically within the threaded connection. Threaded mounting of the head ring onto the barrel sufficiently compressed the cup reflector and acrylic cover against the head ring to provide waterproofing of the head assembly.

With the recent price reductions of super bright white light LED's, there has been a push to incorporate these new LED's into flashlight assemblies. In many cases, manufacturers are simply creating new bulb assemblies using a single LED or multiple LED's. These assemblies are known as based LED's. They include appropriate circuitry for voltage control and can be threaded into the same sockets as a conventional incandescent bulb. The manufacturer simply installs the based LED assembly into the old flashlight assembly. In this manner, no modifications of the flashlight head or housing are required.

However, the light emitted from these based LED assemblies is not ideal because LED's have a different light emission pattern that does not reflect correctly off of the cup reflector. While retrofit based LED's have bridged the gap in introduction of LED's into flashlights, there are drawbacks to this retrofit approach as noted above. Accordingly, there is perceived to be a need in the art for an entirely new head assembly specifically engineered for the physical constraints of the LED package as well as the optical needs of LED semiconductor light source.

SUMMARY OF THE INVENTION

In this regard, and in furtherance of the above stated objectives, the present invention provides a novel waterproof head assembly specifically designed for LED light sources. The first novel design aspect of the head assembly is that the LED's are not enclosed behind an acrylic cover. LED's are ruggedly packaged and not susceptible to the same type of damage, as would an incandescent bulb. Accordingly, the rounded end surface of the LED package need not be protected within an enclosure. The rounded end surfaces of the LED are thus exposed to the outside environment through apertures formed in a solid end wall of the head assembly. In this regard, the apertures in the end wall now provide an entry point for unwanted fluid contaminants, i.e. water, into the interior of the flashlight. The second novel design aspect of the present head assembly comes from a need to compensate for this new entry point. To prevent water from entering into the interior of the flashlight through the apertures, the applicant has filled the interior cavity of the head with a sealant which substantially entirely fills all of the gaps between the outside surfaces of the LED's, the inside surfaces of the apertures, and the inside surfaces of the open end of the head assembly.

More specifically, the sealed head assembly comprises a tubular enclosure including a tubular sidewall, and an end wall, wherein the inner surfaces of the end wall and the sidewall cooperate to define an open end of said enclosure. The end wall includes a plurality of inwardly extending apertures for receiving the LED's therein. The head assembly further comprised a circuit board (mounting board), which is snugly received in interfitting engagement within the inner sidewalls of the open end of the enclosure. In this regard, the inner or upper surface of circuit board and the inner surfaces of the sidewall and the end wall cooperate to define a substantially enclosed interior cavity within the tubular enclosure. A plurality of LED's are mounted on the inner surface of the circuit board in electrical communication with contact leads on the circuit board. When the circuit board is received in interfitting engagement within the sidewalls of the enclosure, the LED's are in turn slideably received within the corresponding plurality of apertures in the end wall. Finally, to prevent water or such other fluid contaminant from entering into the flashlight through the open apertures, a sealant is injected into the enclosed interior cavity through a hole in the circuit board so as to substantially entirely fill the enclosed interior cavity.

It is therefore an object of the present invention to provide a sealed head assembly for an LED light wherein the LED lighting elements are exposed to the outside environment. It is another object of the invention to provide a sealed head assembly for an LED light which includes a minimal number of parts and is simple to assemble for mass production. It is a further object of the present invention to provide a sealing assembly for a flashlight head that has improved performance characteristics, such an internally formed and protected seal that is not exposed to normal wear. It is yet another object of the present invention to provide an in-line flashlight sealing assembly that is completely enclosed within the body of a flashlight thereby eliminating the possibility of contamination and damage from external forces.

Other objects, features, operational details and advantages of the invention shall become apparent as the description thereof proceeds when considered in connection with the accompanying illustrative drawings.

BRIEF DESCRIPTION OF THE DRAWINGS

In the drawings which Illustrate best mode presently contemplated for carrying out the present invention.

DETAILED DESCRIPTION OF THE INVENTION

Figure 1:
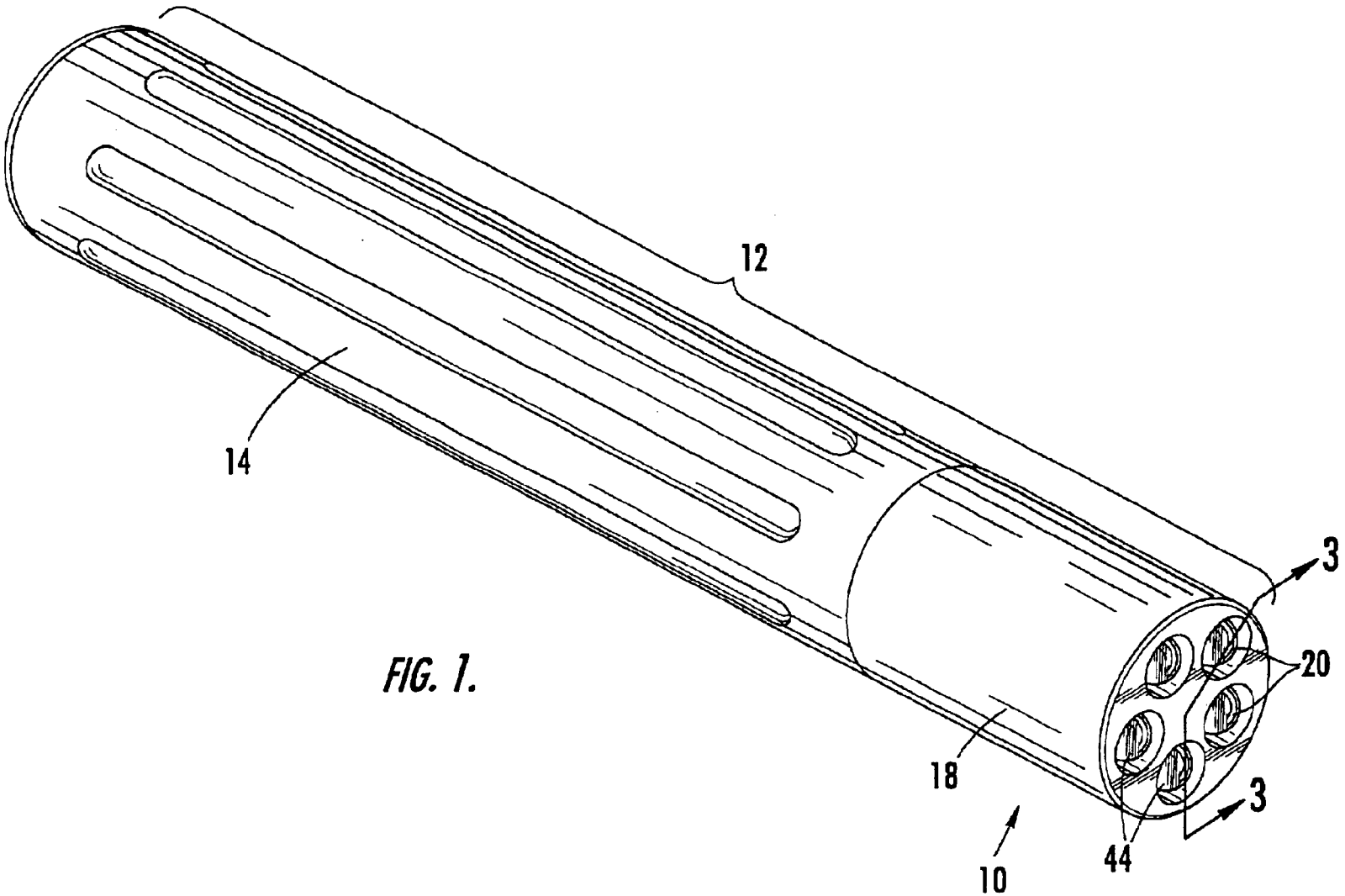
FIG. 1 is a perspective view of a flashlight containing the reverse operating switch mechanism of the present invention.

Referring now to the drawings, a completed flashlight assembly incorporating the reverse-acting switch mechanism and sealed flashlight head of the present invention is generally indicated at 12 in FIGS. 1–3*a*. While the sealing assembly is shown i ted into a flashlight in the description of th preferred embodiment, the present disclosure provides that the sealing assembly as described can be incorporated into a variety of other devices that require a sealed lighting assembly having the same or similar operational characteristic. As will hereinafter be more fully described, the present invention provides a fully contained waterproof inline flashlight assembly that provides improved operating features, higher durability and easier assembly as compared to similar flashlights in the prior art. The entire assembly is contained in a simple housing to provide a useful, novel and improved light source.

The flashlight 12 generally includes an elongated housing 14, batteries 16 disposed in the housing 14, and a flashlight head portion 10.

The flashlight head 10 has an outer enclosure 18 that at least partially encloses at least one light emitting diode (LED) 20, and a circuit component 22, as well as the reverse switch assembly.

Figure 2:
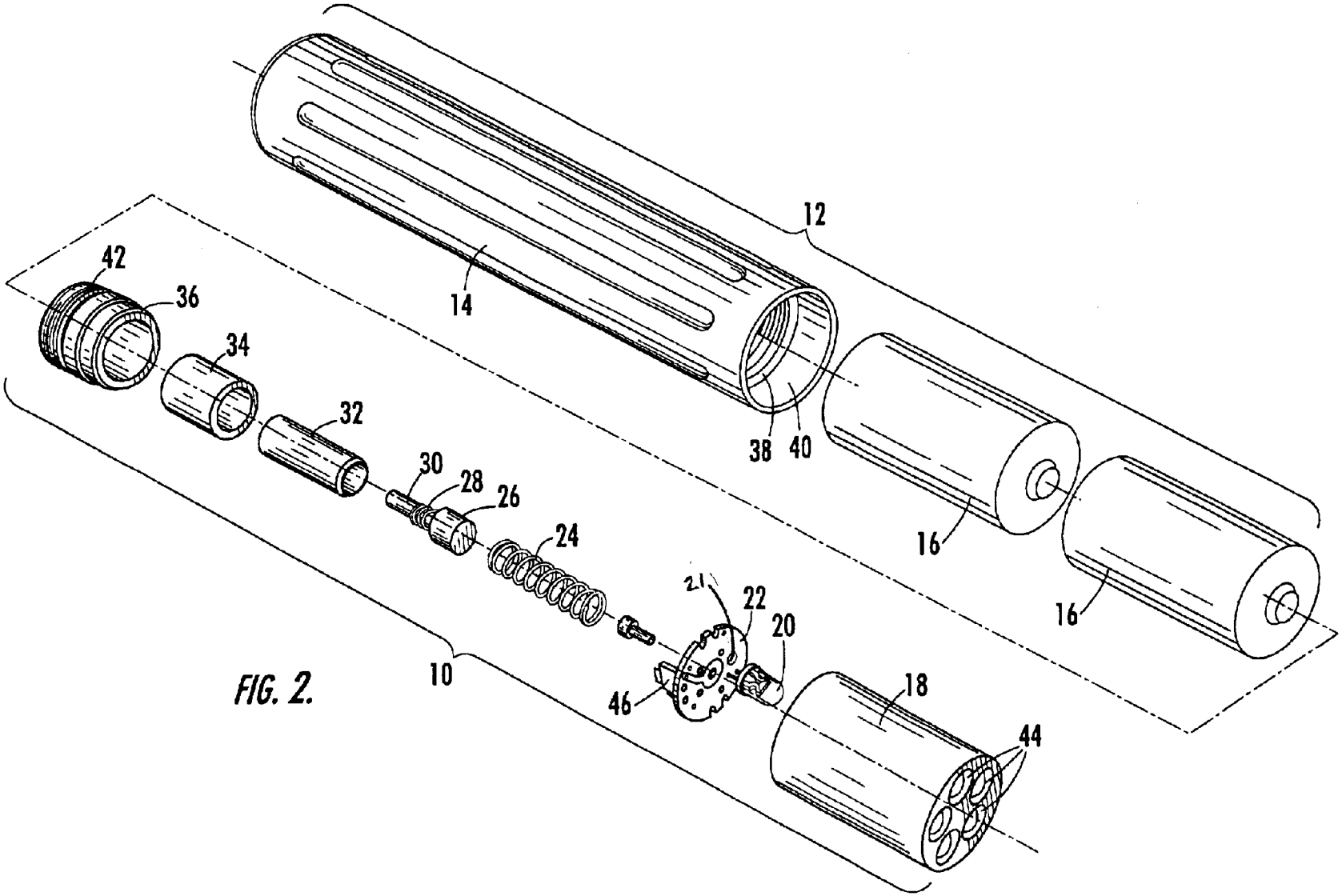
FIG. 2 is an exploded perspective view thereof.

The reverse switch assembly is best shown in FIG. 2, and includes a spring 24, an insulator disk 26, a contact spring 28, a plunger 30, a contact tube 32, and a switch housing 34. The flashlight head 10 further includes a lower enclosure 36 assembled in a permanent fashion to the outer enclosure 18 to enclose both the switching assembly and light source 20 of the flashlight 12 inside the flashlight head 10.

Turning to FIG. 1 an assembled view of the flashlight 12 of the present invention is shown. The outer shape of the flashlight 12 is formed by the battery housing 14 and the outer enclosure 18 of the flashlight head 10 where the battery housing 14 also serves as the handle for the flashlight 12. Both the battery housing 14 and the outer enclosure 18 are formed of a metallic material such as milled aluminum or stainless steel. This allows both of these components to be electrically conductive and employed as components of the overall circuitry of the flashlight 12 as will be further described below.

FIG. 2 shows the flashlight 12 and the flashlight head 10 of the present invention in an exploded perspective view, illustrating the general relationship between all of the components in the overall device. The battery housing 14 is generally tubular in shape having a closed bottom and an open top. The battery housing 14 is generally hollow with an opening 38 that is of a diameter particularly suited to receive batteries 16. In the preferred embodiment, the battery housing 14 is shown of a dimension to accept two batteries 16, however, the present invention will operate equally well using one, three, four or more batteries 16 and the length of the battery housing 14 will be adjusted accordingly to accommodate the number of batteries 16 used. The inner surface of the open end 38 of the battery housing 14 has female threads 40 that are designed to engage corresponding male threads 42 on the lower enclosure 36 thereby maintaining the flashlight 12 in an assembled condition and allowing the head portion 10 to be rotated relative to the battery housing 14. Rotation of the head 10 relative to the housing 14 selectively adjusts the relative positions to one another. When the batteries 16 are installed into the battery housing 14 one contact of the battery 16 is in electrical communication with the bottom of the battery housing 14. Since the battery housing 14 is metallic, electricity is therefore conducted from the battery 16 contact, through the bottom of the battery housing 14 and up through the battery housing 14 into the flashlight head 10 as will be further described below.

The head 10 portion of the flashlight 12 has an outer enclosure 18 that receives and houses all of the switching components and the light source of the flashlight. The outer enclosure 18 is also formed of a machined metallic material that is electrically conductive, such as machined aluminum or stainless steel. The outer enclosure 18 is cylindrically shaped, having an opening at one end into which all of the remaining components are installed and several smaller openings 44 at the other end through which the installed LED lamps 20 protrude. Circuit assembly 22 is typically a printed circuit board onto which the LED lamps 20 are mounted. The circuit assembly 22 has circuit traces connecting one pole of each LED 20 to a metal connection tab 46 and the other pole of each LED 20 to a central connection point 52 on the bottom surface of the circuit assembly 22. Once the LED lamps 20 are installed onto the circuit assembly 22, it is slid into the opening in the outer enclosure 18, so that the LED lamps 20 protrude through the openings 44 in the outer enclosure 18. The connection tab 46 is in electrical communication with the wall of the outer enclosure 18, thereby completing a path of electrical conductivity from the first contact of battery 16, through the battery housing 14 up into the outer enclosure 18 of the head and into the circuit assembly 22 through connection tab 46. The remaining portion of the electrical circuit is completed through the switch components as will be discussed below. In addition to providing paths of conductivity to each of the LED lamps 20, the circuit assembly 22 may also include additional circuitry for controlling the flow of current through the LED lamps 20 or to provide additional functionality, such as flashing, to the flashlight 12.

The principal component of the switch mechanism is plunger 30. The plunger 30 is substantially cylindrical and formed from a metallic material such as machined brass. One end of the plunger 30 is in contact with the second contact end of the battery 16 when the flashlight 12 is fully assembled. The opposite end of the plunger has a raised shoulder 48. The raised shoulder 48 serves to retain contact spring 28 in an operative position on the plunger 30. During assembly, the contact spring 28 is slid onto the plunger 30 and is pressed onto the raised shoulder 48 so that the spring is frictionally retained and in firm electrical communication with the plunger 30. Further, insulator disk 26 is attached to the end of the plunger 30 opposite the battery 16 contact. This sub-assembly (plunger 30, contact spring 28 and insulator disk 26) is then slid into contact tube 32.

Contact tube 32 is a cylindrically shaped tube that is open on the top end and has a bottom wall. The bottom wall has an opening 54 that has a diameter slightly greater than the diameter of the plunger 30. The remaining portion of the bottom wall forms switch contact 50. The plunger 30, contact spring 28 and insulator disk 26 are slid into the open end of the contact tube allowing the contact end of the plunger to protrude through the opening 54 in the bottom wall of the contact tube 32 without making physical or electrical contact with switch contact 50 In this regard, the insulator disk 26 is sized to have a diameter that is only slightly smaller than the diameter of the contact tube 32.

This allows the insulator disk 26 to slide freely up and down inside the contact tube 32 while supporting the plunger 30 in the center of the contact tube 32 and preventing the plunger 30 from contacting the sides of the contact tube 32. The insulator disk 26 is formed from a non-conductive material and is preferably a plastic material. Biasing spring 24 is then installed into the contact tube 32 behind the insulator disk 26. The biasing spring 24 has a diameter that is also only slightly smaller than the inner diameter of the contact tube 32 and is in electrical communication with the innerwalls of contact tube 32 and with the central connection point 52 on the circuit assembly 22 when the entire flashlight head 10 is assembled. The contact tube 32 including the switch components described above is installed into the switch housing 34, which consists of cylindrical support housing that is electrically insulative and designed to isolate contact tube 32 from the rest of the flashlight head assembly 10.

The switch housing 34, after the above-described assembly, is then placed into the lower enclosure 36. The lower enclosure 36 is a metallic component having an opening in its center into which the entire switching assembly is placed. The lower enclosure has an opening in its center to allow the plunger 30 to protrude and contact the battery 16 in an assembled position. The lower enclosure 36 also has male threads 42 that correspond to the female threads 40 on the interior of the battery housing 14. To complete the assembly of the head 10, the lower enclosure 36 containing all of the switching components, is pressed into the outer enclosure 18 using a hydraulic press (not shown) or similar method known in the art. This provides a completed flashlight head 10 that is sealed, having no parts that are accessible by the user. The head 10 is then threaded into the battery housing 14, which already contains batteries 16 to complete the assembly of the flashlight 12. To further seal the flashlight assembly 12 and prevent water infiltration, an O-ring gasket 56 is provided in a groove 58 in the side of lower enclosure 36. The O-ring gasket 56 serves to seal the operable junction between the flashlight head 10 and the battery housing 14 prevent infiltration of water or other contaminants. Additionally, sealant 60 in the preferred embodiment is a UV curable potting compound, but may be any suitable sealant such as silicone, epoxy, rubber or any other sealant well known in the relevant art, is installed in the gap between the LED lamps 20 and the openings 44 in the outer enclosure 18 to further prevent infiltration to the interior of the flashlight 12. To facilitate installation of the sealant 60, an opening 21 may be provided in the circuit board 22 through which the sealant 60 can be injected.

Figure 3:
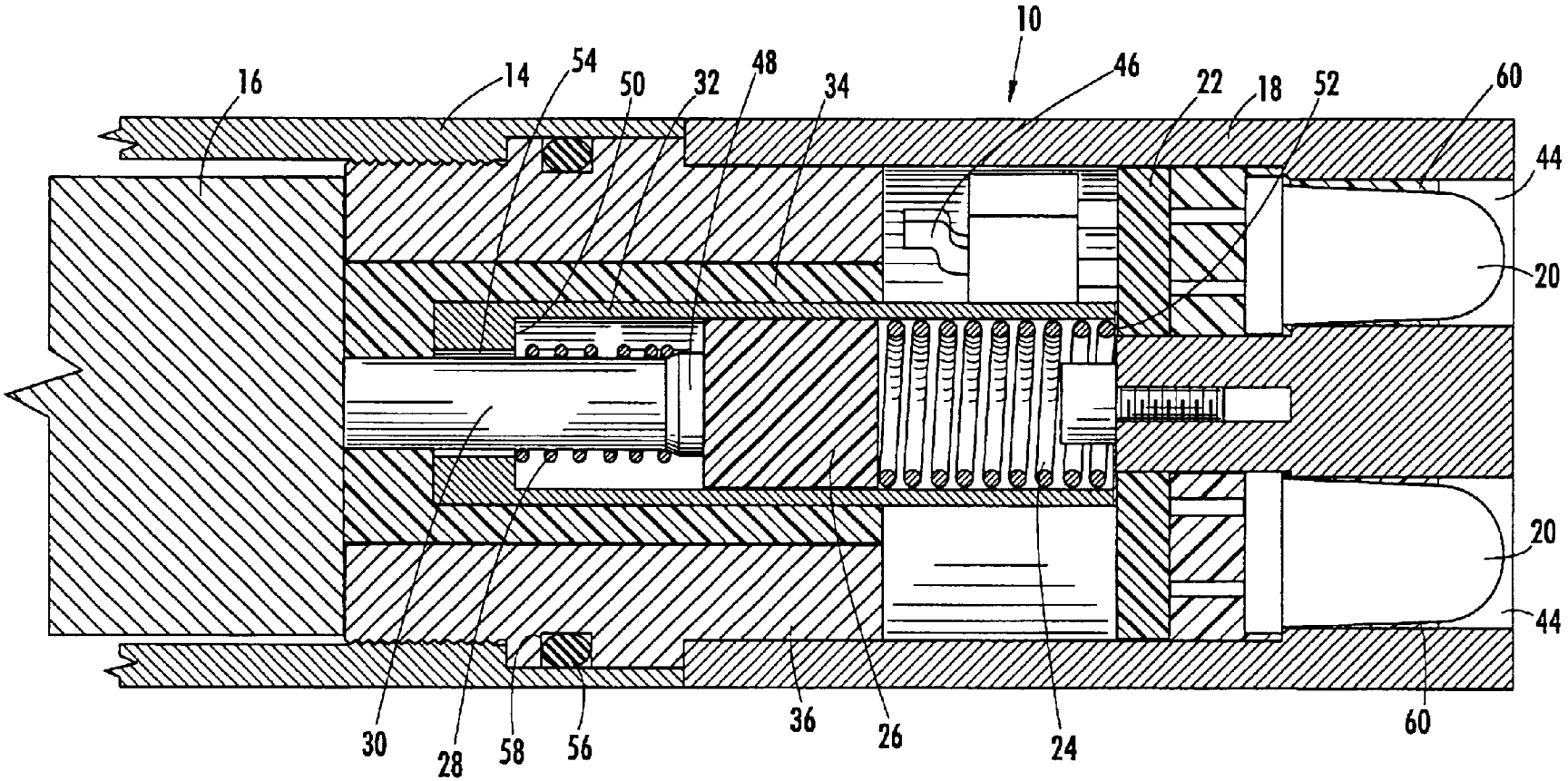
FIG. 3 is a cross-sectional view of the flashlight of the present invention in FIG. 1 along the section line 3—3 in the normally open, off position.
Figure 3A:
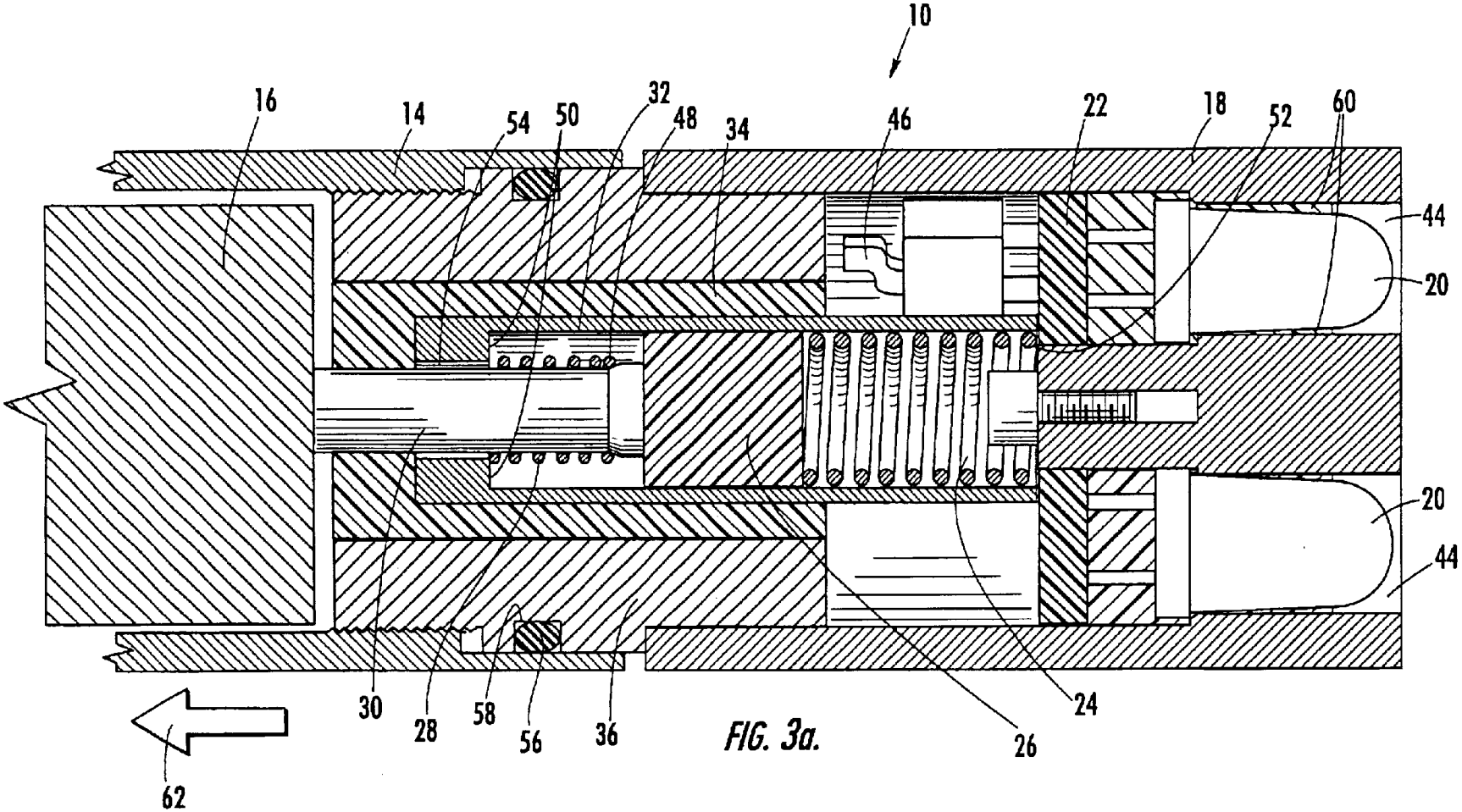
FIG. 3*a* is a cross-sectional view of the flashlight of the present invention in FIG. 1 along the section 3—3 in the closed, on position.

Turning to FIGS. 3 and 3*a* a section is shown of the flashlight 12 of the present invention in the operational state. FIG. 3 shows the flashlight 12 in the normally open, off state, and FIG. 3*a* shows the flashlight 12 in the closed, on state. In FIG. 3 the flashlight head 10 is shown threaded completely into the battery housing 14. In this state, as can be seen, there is a gap between contact spring 28 and the bottom surface of the switch contact 50. This gap is a break in the electrical circuit of the flashlight 12 and prevents the batteries 16 from energizing the LED lamps 20. While plunger 30 is spring biased by the force of spring 24 in the direction of the batteries 16, it is not allowed to move in the direction of the batteries 16 because of the proximity of the batteries 16 to the flashlight head 10. In other words, when the flashlight head is screwed entirely onto the battery housing 14, the batteries 16 force the plunger upwardly against spring 24. Because the spring 28 is connected to the top of the plunger, the contact spring 28 is moved out of electrical contact with the bottom of the contact tube 50.

In FIG. 3*a*, the battery housing 14 is shown as being slightly unscrewed from the flashlight head 10 as indicated by the arrow 62, or vice versa, the head 10 is unthreaded from the body 14. This displacement of the battery housing 14 results in displacement of the batteries 16 from the flashlight head 10 by the same distance. Since the plunger 30 is spring biased in the direction of the batteries 16 by spring 24, this linear displacement of the batteries 16 allows the spring 24 to expand and thus displace the plunger 30 rearwardly by the same distance as the battery housing 14 and the batteries 16. Once the distance of displacement of the plunger 30 is sufficient, the contact spring 28 comes into contact with switch contact 50. When this contact is made it can be seen that a complete electrical circuit is provided starting at the top battery 16 contact through the plunger 30, the contact spring 24, switch contact 50, contact tube 32, secondary spring 24, central contact 52, into the circuit assembly 22 and the LED lamps 20, through contact tab 46, back into the outer housing 18, through the lower housing 36, into the battery housing 14 and finally to the bottom contact of battery 16. Therefore, by translating the battery housing 14 in a rearward direction 62 from the flashlight head 10 an electrical circuit is completed thereby energizing the flashlight 12.

It can also be seen in FIG. 3*a* that at the point where contact spring 28 initially contacts switch contact 50, the contact spring 28 is not compressed. Since the spring force in the secondary spring 24 is greater than the spring force in the contact spring 28, further displacement of the battery housing 14 and batteries 16 in the rearward direction 62 allows the plunger 30 to also be further displaced in the rearward direction 62. As the plunger 30 is further displaces by secondary spring 24, contact spring 28 is further compressed allowing the plunger 30 to remain in contact with the battery 16 until the contact spring 28 is completely compressed. The use of the contact spring 28 and secondary spring 24 in this manner provide for the extended operational range provided for under the present invention.

It can therefore be seen that the instant invention provides a compact inline flashlight switching mechanism that is fully enclosed and sealed against infiltration of water of other contaminants. It can be further seen that the present invention provides a novel reverse acting switch design that provides for smooth operation and an extended operational range through the use of spring contacts. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A sealed head assembly for an LED light comprising:

a tubular enclosure including a tubular side wall, and an end wall, wherein inner surface of said end wall and said side wall cooperate to define an open end of said enclosure, said end wall having at least one aperture extending between the interior of the enclosure and the exterior of the enclosure;

a mounting board received in interfitting engagement within said inner side walls of said open end of said enclosure wherein an inner surface of said mounting board and said inner surfaces of said side wall and said end wall cooperate to define a substantially enclosed interior cavity within said tubular enclosure;

at least one LED mounted on said inner surface said mounting board, said at least one LED being slideably received within said at least one aperture in said end wall; and a sealant substantially entirely filling said enclosed interior cavity, such that contaminants cannot enter into said enclosed interior cavity through said at least one aperture in said end wall.

2. The sealed head assembly of claim 1, further comprising;

a plurality of LED's mounted on said mounting board, said end wall including a like plurality of inwardly extending apertures to slideably receive said plurality of LED'S.

3. The sealed head assembly of claim 1, wherein said mounting board comprises a circuit board having contact leads thereon, and further wherein said at least one LED includes spaced leads that are mounted on said circuit board in electrical communication with said contact leads.

4. The sealed head assembly of claim 1, wherein a gap is formed between an outer surface of said LED and said inner surface of said inwardly extending aperture when said LED is slideably received therein, said sealant filling at least a portion of said gap.

5. A flashlight assembly comprising:

a housing having a bottom wall and a side wall extending upwardly from said bottom wall, an electrically conductive path extending from said bottom wall upwardly along said side wall and a threaded opening opposite said bottom wall;

a battery having a first contact and a second contact said battery received within said housing wherein said first contact is in electrical communication with electrically conductive path;

a flashlight head, said flashlight head including, a tubular enclosure having a side wall, and an end wall, wherein inner surfaces of said end wall and said side wall cooperate to define said tubular enclosure having an open end, said end wall having at least one aperture extending between the interior of the enclosure and the exterior of the enclosure, a mounting board received in interfitting engagement within said inner side walls of said open end of said enclosure wherein an inner surface of said mounting board and said inner surfaces of said side wall and said end wall cooperate to define a substantially enclosed interior cavity within said tubular enclosure, at least one LED mounted on said inner surface said mounting board having first and second contact leads, said first contact lead in electrical communication with said first contact of said battery, said at least one LED being slideably received within said at least one aperture in said end wall, and a sealant substantially entirely filling said enclosed interior cavity, such that fluid contaminants cannot enter into said enclosed interior cavity through said at least one aperture in said end wall, said head being received in said opening In said housing; and a switch assembly disposed between said second contact lead of said LED and said second contact of said battery, said switch assembly being operable to selectively energize said lighting element.

6. The flashlight assembly of claim 5, further comprising:

a plurality of LED's mounted on said mounting board, said end wall including a like plurality of inwardly extending apertures to slideably receive said plurality of LED's.

7. The flashlight assembly of claim 5, wherein said mounting board comprises a circuit board having contact leads thereon, and further wherein said first and second contact leads of said LED are mounted on said circuit board in electrical communication with said contact leads.

8. The flashlight assembly of claim 5, wherein a gap is formed between an outer surface of said LED and said inner surface of said inwardly extending aperture when said LED is slideably received therein, said sealant filling at least a portion of said gap.

9. An LED assembly comprising:

a housing;

a power source mounted within said housing; and a sealed LED head assembly mounted to said housing, said sealed LED head assembly including, a tubular enclosure including a tubular side wall, and an end wall, wherein inner surfaces of said end wall and said side wall cooperate to define an open end of said enclosure, said end wall having at least one aperture extending between the interior of the enclosure and the exterior of the enclosure, a mounting board received in interfitting engagement within said inner side walls of said open end of said enclosure wherein an inner surface of said mounting board and said inner surfaces of said side wall and said end wall cooperate to define a substantially enclosed interior cavity within said tubular enclosure, at least one LED mounted on said inner surface said mounting board, said at least one LED being slideably received within said at least one aperture in said end wall, said at least one LED being in electrical communication with said power source, and a sealant substantially entirely filling said enclosed interior cavity, such that contaminants cannot enter into said enclosed interior cavity through said at least one aperture in said end wall.

* * * * *